US012582245B1

(12) United States Patent
Allen

(10) Patent No.: US 12,582,245 B1
(45) Date of Patent: Mar. 24, 2026

(54) LOCKER WITH FOLD-DOWN JEWELRY TRAY

(71) Applicant: AIM Design, LLC, Desoto, TX (US)

(72) Inventor: Sam Allen, Maypearl, TX (US)

(73) Assignee: AIM Design, LLC, Desoto, TX (US)

( * ) Notice: Subject to any disclaimer, the term of this patent is extended or adjusted under 35 U.S.C. 154(b) by 106 days.

(21) Appl. No.: 18/402,833

(22) Filed: Jan. 3, 2024

(51) Int. Cl.
*A47F 7/02* (2006.01)
*A47B 61/02* (2006.01)
*A47B 83/00* (2006.01)

(52) U.S. Cl.
CPC ..... *A47F 7/02* (2013.01); *A47B 61/02* (2013.01); *A47B 83/00* (2013.01); *A47B 2220/0077* (2013.01)

(58) Field of Classification Search
CPC . A47F 7/02; A47F 11/10; A47F 3/001; A47B 61/02; A47B 83/00; A47B 2220/0077; A47B 88/60; A47B 88/42; A47B 88/48; A47B 61/00; A47B 81/00; A47B 46/005; A47B 61/04; A47B 46/00
See application file for complete search history.

(56) References Cited

U.S. PATENT DOCUMENTS

| | | | | |
|---|---|---|---|---|
| 5,415,472 | A * | 5/1995 | Brise | A47B 96/025 211/153 |
| 5,707,126 | A * | 1/1998 | Neufeld | A47B 46/00 312/317.3 |
| 6,055,688 | A * | 5/2000 | Helmsderfer | A47D 5/003 5/655 |
| 6,450,599 | B1 * | 9/2002 | Mamuyac | A47B 46/005 312/258 |
| 8,109,581 | B1 * | 2/2012 | Lazenby | A47B 88/42 312/330.1 |
| 2002/0043606 | A1 * | 4/2002 | Fell | A47F 5/0846 248/441.1 |
| 2016/0258108 | A1 * | 9/2016 | Jindra | A47B 81/00 |
| 2017/0177031 | A1 * | 6/2017 | Lesizza | A47B 88/994 |
| 2017/0295928 | A1 * | 10/2017 | Allen | A47B 61/04 |
| 2017/0295960 | A1 * | 10/2017 | Allen | A47F 11/10 |
| 2018/0058760 | A1 * | 3/2018 | Allen | A47B 83/00 |
| 2018/0242735 | A1 * | 8/2018 | Allen | A47B 83/00 |
| 2019/0254422 | A1 * | 8/2019 | Beere | A47B 96/07 |
| 2019/0365094 | A1 * | 12/2019 | Allen | F24F 13/0604 |
| 2019/0374838 | A1 * | 12/2019 | Allen | A47B 46/005 |
| 2020/0229599 | A1 * | 7/2020 | Filipowicz | A47B 88/402 |
| 2021/0199279 | A1 * | 7/2021 | Allen | A47F 3/001 |
| 2025/0078141 | A1 * | 3/2025 | Wong | G06Q 10/0836 |

* cited by examiner

*Primary Examiner* — Hiwot E Tefera
(74) *Attorney, Agent, or Firm* — James E. Walton

(57) ABSTRACT

A locker has a pair of sidewalls and a back wall connecting the sidewalls. The locker has a plurality of compartments which are defined between these sidewalls. A seat is also positioned between the sidewalls of the locker. A fold-down jewelry tray is positioned inside of the locker for storing personal items. At least one illumination panel is also included with the locker.

12 Claims, 8 Drawing Sheets

LOCKER WITH FOLD-DOWN JEWELRY TRAY

BACKGROUND

1. Field of the Invention

The present invention relates generally to improvements in lockers or storage cabinets used in athletic or sporting facilities, and more specifically to jewelry trays or other storage trays within those lockers.

2. Description of Related Art

The aesthetics and utility of lockers or storage cabinets in "locker rooms" of athletic and sporting facilities of sports teams and country clubs, for example, have become a measure of the quality and prestige of such organizations and an increasingly important aspect of recruiting new team or club members. Modern lockers are a far cry from the simple wood or metal cabinets of the past.

Modern lockers incorporate storage for specific items of equipment, such as helmets and shoes, and features promoting comfort and luxury. There is a constant need for improvement in both functional and aesthetic aspects of such lockers.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
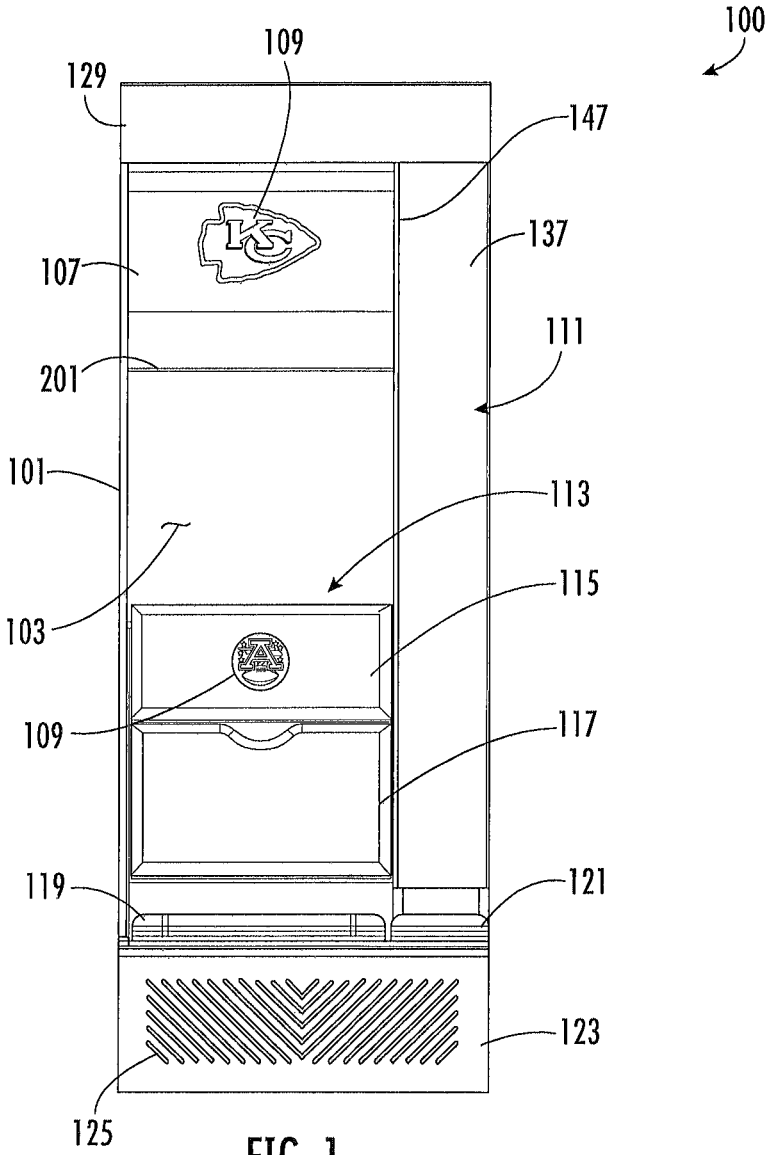
FIG. 1 is a front view of a locker with jewelry tray folded-up according to a preferred embodiment of the present application.

While the assembly and method of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the locker according to the present application are provided below. It will of course be appreciated that in the development of any actual embodiment, numerous implementation-specific decisions will be made to achieve the developer's specific goals, such as compliance with assembly-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. It is also appreciated that the use of "a" or "an" before a noun naming an object is construed to be that the noun is in the singular and not the plural unless the context sufficiently indicates otherwise.

Figure 2:
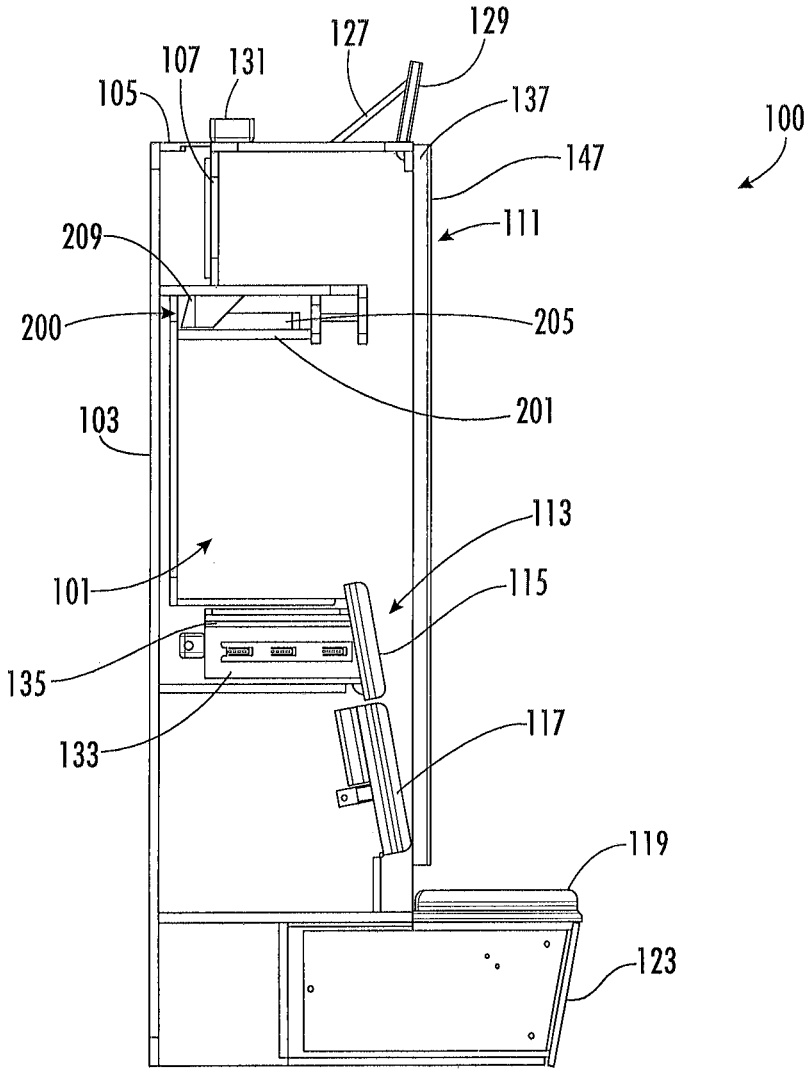
FIG. 2 is a right-side cross-section view of the locker with jewelry tray folded up from FIG. 1 according to a preferred embodiment of the present application.

Referring now to FIGS. 1 and 2 in the drawings, locker 100 according to the preferred embodiment of the present application is depicted. FIG. 1 provides a front view of locker 100 while FIG. 2 provides a cross-section view of locker 100 to fully show all of locker's 100 features. As shown, locker 100 is comprised of opposing side walls 101, a back wall 103, a top wall 105, light up panel 107, logo 109, side compartment 111, seat assembly 113, headrest 115, seatback 117, bench 119, side cushion 121, support panel 123, ventilation apertures 125, support bar 127, illumination panel 129, junction box 131, headrest compartment 133, self-closing soft-close rails 135, jewelry tray 200, jewelry tray base 201, jewelry tray walls 205, and jewelry tray metal stop 209. In FIGS. 1 and 2, jewelry tray 200 is depicted in the folded-up position which is the resting position for jewelry tray 200.

Locker 100 is generally comprised of a pair of upstanding side walls 101 that generally define the extent of locker 100. A back wall 103 connects side walls 101 at the rear of locker 100 and a top wall 105 connects side walls 101 at the top. Side walls 101, back wall 103, and top wall 105 may be made of various materials, including wood, laminates, polymers, metals, and composites. The material choice will depend upon the properties desired for the chosen application and embodiment of locker 100. For example, if locker 100 will be holding dirty and wet equipment, polymer may be better suited for construction since polymer is durable and easy to clean, whereas if locker 100 is at a prestigious or upscale institution, locker 100 might be made from wood or laminate since wood and laminate create a nicer appearance. Each locker 100 may be installed adjacent to another, similar or identical locker 100, with locker's 100 back wall 103 against a wall, and locker's 100 front facing the interior of a locker room. Locker 100 may also be installed behind and facing the opposite direction of another, similar or identical locker 100, with locker's 100 back wall 103 against the back wall 103 of another locker 100 and locker's 100 front facing the interior of a locker room. Sidewalls 101 and back walls 103 may be arranged to create an interior area of locker 100.

Between the sidewalls 101 of locker 100, a plurality of compartments may be defined by shelves or other horizontally extending surfaces or platforms. As used herein, "sidewall" or "sidewalls" may refer to either "main" sidewalls 101 or other upstanding or generally vertical sidewalls arranged between "main" sidewalls 101. Multiple additional sidewalls 101 may be placed between the "main" or exterior sidewalls 101 to define compartments in cooperation with generally horizontally extending shelves or platforms. The sidewalls and shelves of the compartments may be made of the same materials of sidewalls 101 and back walls 103 of locker 100, or may be made of differing materials, depending on the desired properties of the specific application and embodiment of locker 100. Each compartment may be sized and otherwise configured for storage of clothing or sporting equipment or other items and may include at least one door which may be locked. Locker 100 may also be decorated by adding logos 109 to different walls and compartments of locker 100. Logos 109 may be used to display the team logo of the locker room where locker 100 is placed or may be separate logos 109 that the user of locker 100 picks out.

At the top of the interior area of locker 100 is rectangular light up panel 107. In the preferred embodiment, light up panel 107 contains logo 109 placed onto the front surface of panel 107. Logo 109 may be a printed logo, an embedded feature, or a separate piece which is removably or permanently attached to light up panel 107. Located either behind light up panel 107 or running along the sides of light up panel 107 will be illumination indica which illuminate light up panel 107 to better display logo 109. The illumination indica may either be always on or may be triggered on and off either at locker 100 or remotely by an individual. The illumination indica may also be placed on a timer to turn on at certain points of the day or may be connected to a sensor to turn on when an individual approaches locker 100. In the preferred embodiment, light up panel 107 is easily removable to allow an individual to modify the surface of panel 107 at will. An alternative embodiment may also exist where panel 107 is instead an electrical display screen which may be freely adjusted while positioned in locker 100. Also in this alternative embodiment light up panel 107 as a display screen may be synchronized with light up panels 107 in other lockers 100 so that the same message can be displayed on every locker 100.

The interior area of the locker 100 contains several features, including a seat assembly 113. Seat assembly 113 generally comprises a headrest 115, a seatback 117, and a bench 119 according to the preferred embodiment in the present application. Also located next to seat assembly 113 is side cushion 121 at the same height as bench 119 which provides another location for an individual to sit at locker 100. Seat assembly 113 components headrest 115, seatback 117, and bench 119 along with side cushion 121 are preferably padded and upholstered with an appropriate material, such as vinyl or leather or other textile material.

The material and design choices for seat 113 will depend on the desired application and embodiment of locker 100. Logos 109 may also be present on components of seat 113. For example, referring to FIG. 1, logo 109 is preferably present on headrest 115. Logo 109 may be a symbol, institution name, image, other graphic, or any combination thereof. Logo 109 may be an embroidered logo, a printed logo, an embedded feature, or a separate piece which is removably or permanently attached to headrest 115. Logo 109 may be standardized among all lockers 100 within the locker room or the individual using locker 100 may decide which logo 109 to add to locker 100.

Parts of seat assembly 113 such as headrest 115 may be easily pulled out from locker 100 to reveal headrest compartment 133. Headrest 115 is the front face of headrest compartment 133 and compartment 133 is connected to side walls 101 by self-closing soft-close rails 135. Rails 135 are located on the top sides of compartment 133 but may be located anywhere along the sides of compartment 133. Rails 135 are self-closing and when an individual is no longer pulling on headrest 115 to keep compartment 133 open, compartment 133 will slide back along rails 135 until compartment 133 has been closed. Rails 135 are also soft closing and will slow down compartment 133 while closing to decrease the speed so that compartment 133 does not get damaged or so that compartment 133 does not damage locker 100 while closing.

Directly below seat assembly 113 is support panel 123 with ventilation apertures 125. Support panel 123 spans the distance between opposing side walls 101 and provides extra structural support to the bottom of locker 100. Support panel 123 further has ventilation apertures 125 at the front which facilitate airflow into the bottom of locker 100. This airflow through apertures 125 will help provide a location where air can enter or exit locker 100 to help dry any equipment stored within locker 100 while also removing any unwanted smells. Support panel 123 is also easily removable to allow access to any mechanical and electrical features stored at the bottom of locker 100 for maintenance.

While not shown, a plenum may be mounted on the rear or exterior side of back wall 103. A plenum may be connected via duct work to the existing HVAC of the locker room or room in which locker 100 is disposed or situated. The HVAC system to which the plenum is connected may be the conventional heating and cooling system of the building or room in which locker 100 is disposed or may be a dedicated system for locker 100. The HVAC system thus provides heated, cooled, and/or dehumidified air to locker 100 through a plenum.

A plenum may communicate air from the HVAC system to the interior and various compartments of locker 100 through a plurality of ventilation apertures or grilles formed in back wall 103. Preferably, a grille or aperture (grille is used herein to mean a single aperture or a group of apertures in any arrangement, e.g. circles, squares, other shapes, arranged in any pattern) is arranged through back wall 103 at least at the upper extent of locker 100 to insure a supply of air to the entirety of locker 100 or at least the upper compartments thereof.

The grilles may preferably be provided with a damper arrangement or mechanism that permits the partial closure or obstruction of the aperture(s) of the grilles to control the flow of air from a plenum. One or more front or forward ventilation grilles may be provided in the front panels or surfaces (such as ventilation apertures 125) of locker 100 to permit exhaust or intake of air from or to locker 100. Alternatively, the natural gaps left between doors and openings in locker 100 can provide the exhaust or intake of air. The grilles and dampers may be controlled (opened or closed, fully or partially) manually or automatically, as by a programmed computer. Automatically controlled grilles may operate on a "schedule" (e.g. open or closed at night or during daylight hours) or according to airflow or other parameters, such as relative humidity in the locker room and the like.

Thus, airflow may be established through locker 100 from a plenum, through ventilation grilles, and out of locker 100 through other grilles or other openings in the front or forward portions of locker 100. Alternatively, air circulated through locker 100 may be exhausted through a duct or conduit to an area remote from locker 100 and/or the locker room or building in which locker 100 is located. Ventilation may also be assisted by one or more circulation fans located in locker 100. Alternative embodiments of locker 100 may contain equipment drying fixtures such as glove dryers or shoe dryers. Some alternative embodiments of locker 100 may also include components to enable ventilation in a seat assembly.

Parts of seat assembly 113 such as headrest 115, seatback 117, and bench 119 along with side cushion 121 may be ventilated and connected through locker 100 to a plenum such that air flows through seat assembly 113 to a user. Airflow to seat 113 may be warm or cool air and may be used to cool or warm a person sitting in seat 113. Seat 113 may also be heated or cooled with other components, such as electrical heating elements, used alone or in combination with ventilation.

Located on top wall 105 of locker 100 are support bar 127, illumination panel 129, and junction box 131. Junction box 131 provides the source of energy to locker 100 to power the electrical components within locker 100. At the front of top wall 105, visible from the front of locker 100 as shown in FIG. 1, is support bar 127 and illumination panel 129. Illumination panel 129 is a rectangular piece of material which runs the length between side walls 101 and is positioned at a downward facing angle at the top of locker 100 so that the entirety of the contents of illumination panel 129 are visible from below. Support bar 127 is used to provide extra support to panel 129 by securing panel 129 at another point on top wall 105. Support bar 127 creates a second point of contact with top wall 105 for illumination panel 129 which increases stability. Illumination panel 129 will either have illumination indica behind panel 129 or running along the sides of panel 129 which will provide light to display the contents of illumination panel 129. Illumination panel 129 may be used to display the information of the player who is currently using locker 100 or any other information that the individual using locker 100 wishes to display. In the present embodiment, illumination panel 129 is detachable from top wall 105 and support bar 127 so that an individual will be able to change what is displayed on illumination panel 129. Illumination panel 129 is slotted so that the individual using locker 100 can insert materials into illumination panel 129 to be displayed. An alternative embodiment may exist where illumination panel 129 is metallic instead of being slotted so that an individual can directly place the material to be displayed onto panel 129. An alternative embodiment may also exist where instead of using illumination panel 129 and changing the inserts, illumination panel 129 will instead be a digital display screen that an individual will be able to remotely change and update. However, in both of these embodiments, the illumination indica or the screen of illumination panel 129 may be controlled to turn on and off at certain times or may be controlled directly by the individual.

FIGS. 1 and 2 also provide an initial view of jewelry tray 200 when tray 200 is in the initial folded-up resting position. As shown in these figures, jewelry tray 200 is comprised of jewelry tray base 201, jewelry tray walls 205, and jewelry tray metal stop 209. When an individual is not wishing to put something onto tray 200, tray 200 will stay in the folded-up position so that the items within tray 200 will not move around. When an individual was pulling on jewelry tray 200 but stops, tray 200 will slowly retract from the folded-down position to the folded-up rest position as shown in these figures.

Figure 3:
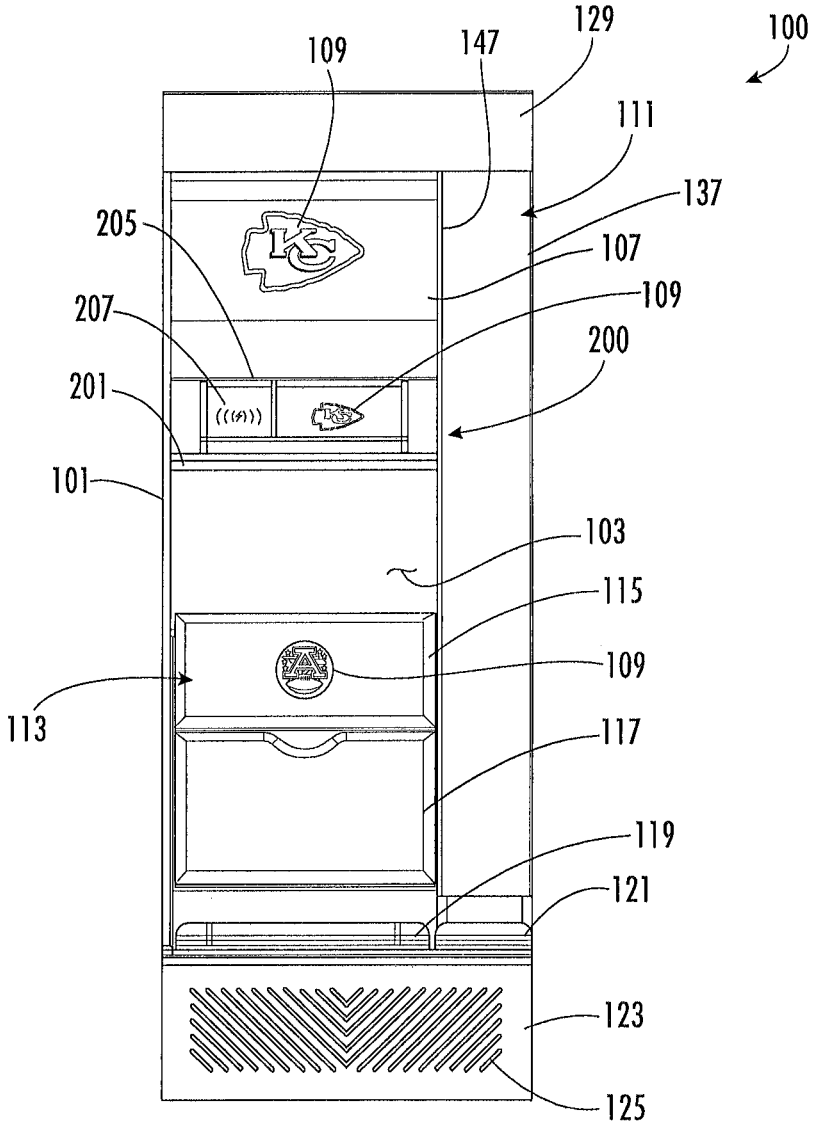
FIG. 3 is a front view of the locker of FIG. 1, providing a folded down view of jewelry tray from FIG. 1.
Figure 4:
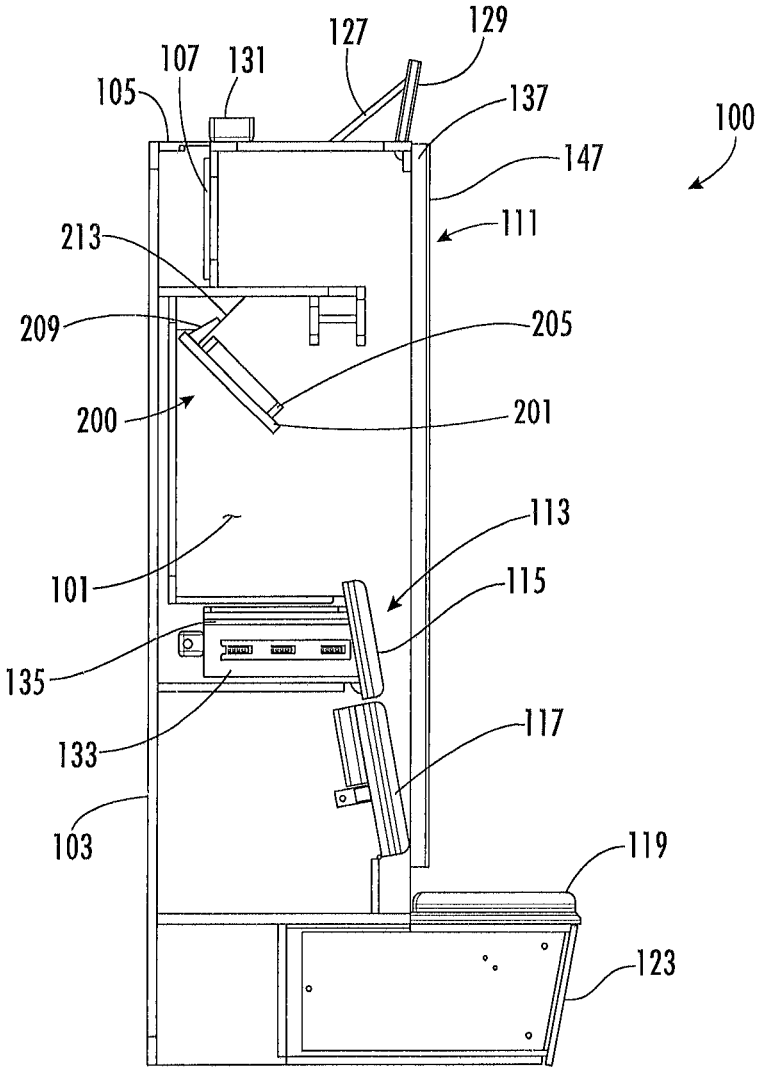
FIG. 4 is a right-side cross-section view of the locker of FIG. 1, providing a folded down view of jewelry tray from FIG. 1.

Referring now also to FIGS. 3 and 4 in the drawings, locker 100 according to the preferred embodiment of the present application is depicted with jewelry tray 200 in the folded-down position. The drawings further show that, along with that was seen in FIGS. 1 and 2, jewelry tray 200 is further comprised of a logo 109, wireless charger 207, and lift arms 213. FIGS. 3 and 4 depict jewelry tray 200 in the folded-down position which happens when an individual pulls down on jewelry tray 200 directly. When jewelry tray 200 is pulled down, an individual will be able to see the full extend of jewelry tray 200 and the individual can then place personal items onto jewelry tray 200 for safe keeping. It is preferred that Jewelry tray 200 folds down in this manner instead of being pulled out directly away from locker 100 so that an individual will be able to easily see the contents of jewelry tray 200 at average standing height. Jewelry tray 200 is also positioned within locker 100 so that an individual will be able to sit up straight in seat assembly 113 without the individual's head bumping into jewelry tray 200.

Figure 5:
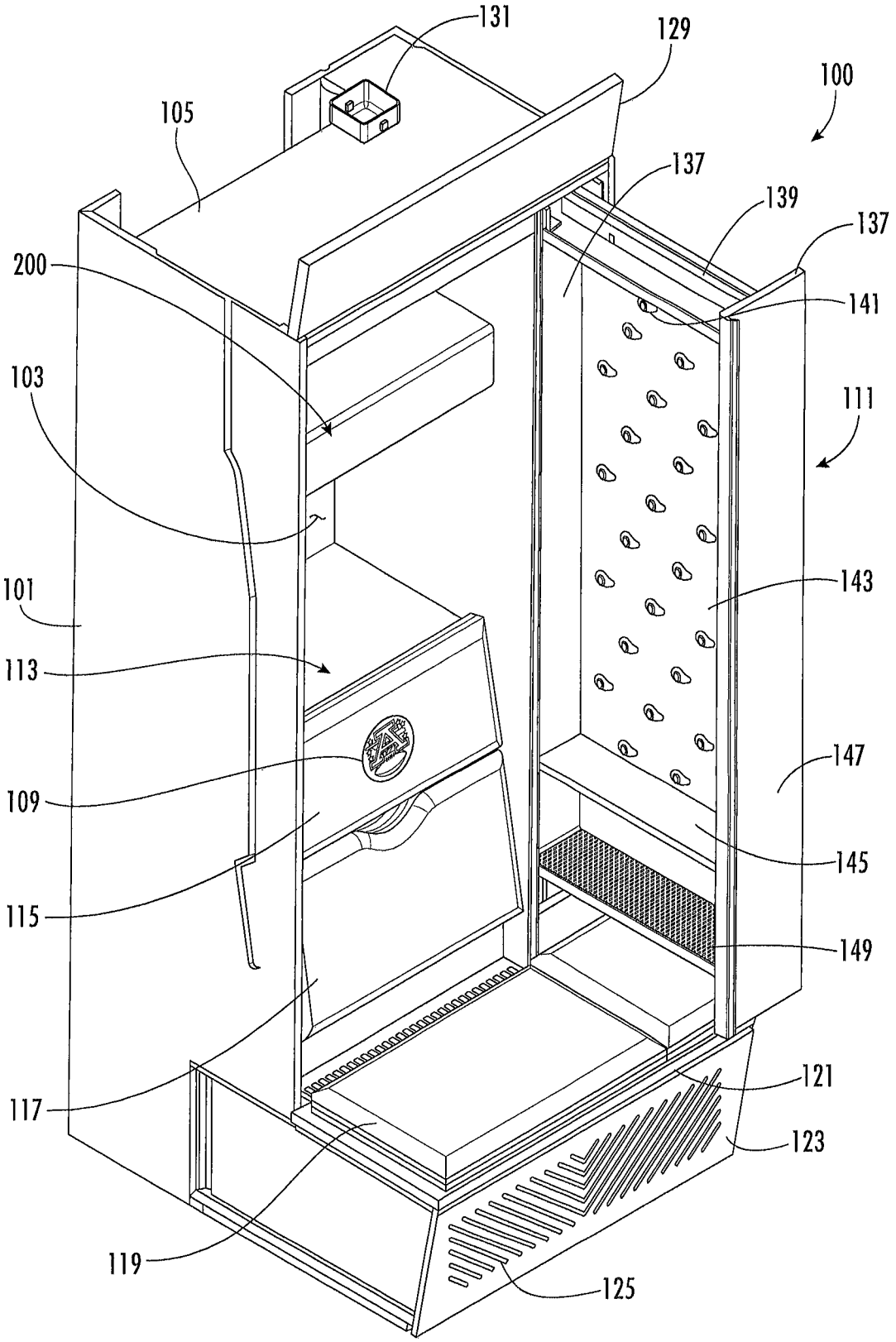
FIG. 5 is a perspective view of the locker of FIG. 1, with the side compartment door open.
Figure 6:
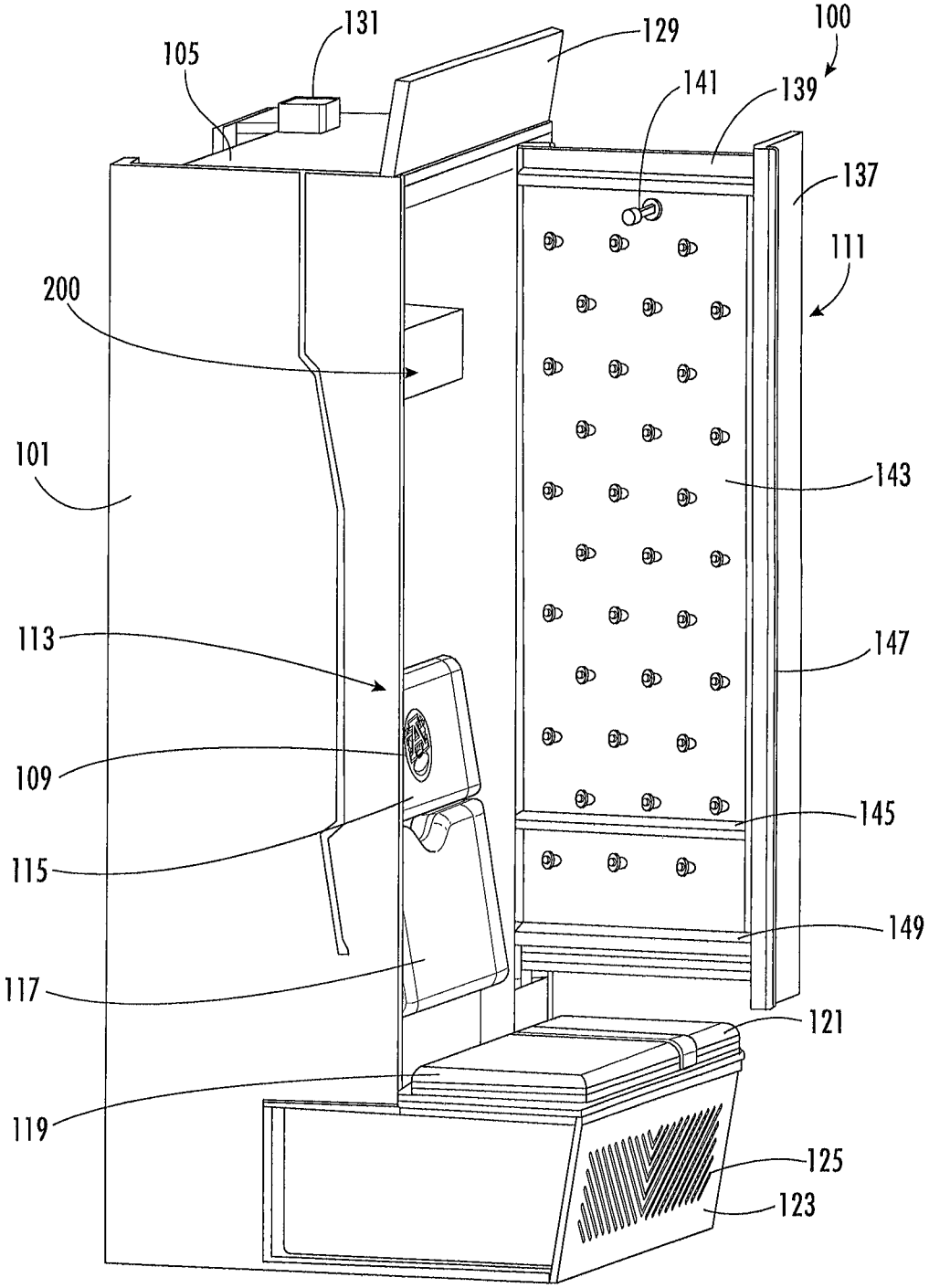
FIG. 6 is a left-side perspective view of the locker of FIG. 1, with the side compartment door open.

To the side of the interior area, locker 100 preferably contains side compartment 111. Referring now also to FIGS. 5 and 6, side compartment 111 is depicted in the open position to allow a view into side compartment 111. Compartment 111 includes a pair of spaced-apart, opposed or opposing front and rear end walls 137, which are connected at the top and bottom. Heavy-duty drawer slides 139 may be mounted at the top and bottom of end walls 137 and are secured to the interior of sidewalls 101 to permit compartment 111 to slide or move between extended and retracted positions. Slides 139 may be located elsewhere along the vertical dimension of compartment 111, as well. Compartment 111 may vary in height, width, and depth but should be large enough in all dimensions to accommodate at least one piece of equipment hung from equipment hook 141. Equipment hook 141 is located at the top of the inside of compartment 111 and is shaped such that an individual will be able to hang clothes or equipment directly onto hook 141 or an individual can place hangers already holding clothing or equipment onto hook 141. While the current embodiment only depicts one equipment hook 141 in the drawings, it is appreciated that alternative embodiments may exist where more than one equipment hook 141 may be located at the top of compartment 111 or equipment hooks 141 may be located on either one or both end walls 137. Compartment 111 may also be provided with illumination in the form of LED lights or other illumination sources. Such illumination may be controlled by switches that turn the illumination on or off as compartment 111 is opened and closed.

At least one side of compartment 111 must be open-faced when compartment 111 is extended from locker 100 to permit access to equipment hook 141. A perforated rear wall 143 may extend between end walls 137 to add strength to compartment 111. The perforations also permit air circulation into compartment 111 to allow equipment to dry. Air may be supplied to compartment 111 by a forced-air ventilation system (either wholly or partially self-contained or coupled to building HVAC). Such ventilation may include anti-odor, anti-fungal, or anti-bacterial treatments. A removable debris tray 145 may be disposed at the bottom of compartment 111 to catch mud, grass, and other debris from equipment stored in compartment 111. Tray 145 may be removed and debris emptied and replaced. Located at the bottom of compartment 111 below removable debris tray 145 is ventilation tray 149. Ventilation tray 149 is perforated section of material extending between end walls 137 to increase how much air can circulate through compartment 111.

In operation, the user pulls shoe compartment 111 from the retracted position into the extended position by using handle 147. The user places recently worn, dirty, and sweaty or otherwise wet equipment onto hook 141. Compartment 111 then may be closed, and any equipment contained within compartment 111 will dry. Any dried mud or grass or other debris falling from equipment may land on tray 145, which may be removed for disposal of the debris. Components of shoe storage compartment 111 may be made of various materials such as metal, wood, laminate, composite, or polymer, depending on the design of locker 100. In the preferred embodiment according to the present application, compartment's 111 components are primarily made of stainless steel.

In the preferred embodiment according to the present application, compartment 111 is shown as being to the right of seat assembly 113 and interior area as seen from the front of locker 100, but could be mounted to the left instead. Other embodiments may have multiple compartments 111, located on either or both sides of seat assembly 113. In the preferred embodiment, compartment 111 extends from the base of locker 100 to the top of locker 100, but in other embodiments, compartment 111 could be shorter to allow more usable space for the rest of lockers 100. For example, in other embodiments compartment 111 may extend upward only enough such that an arm rest may be mounted above compartment 111 for a user in seat assembly 113. Compartment 111 may also be split into multiple pieces. For example, an alternative embodiment may have one enclosure for compartment 111 but contain two separate storage drawers within the enclosure, one mounted above the other. Alternatively, locker 100 may not contain compartment 111 at all, and may either be more compact as a result or provide a wider seat assembly 113.

Figure 7:
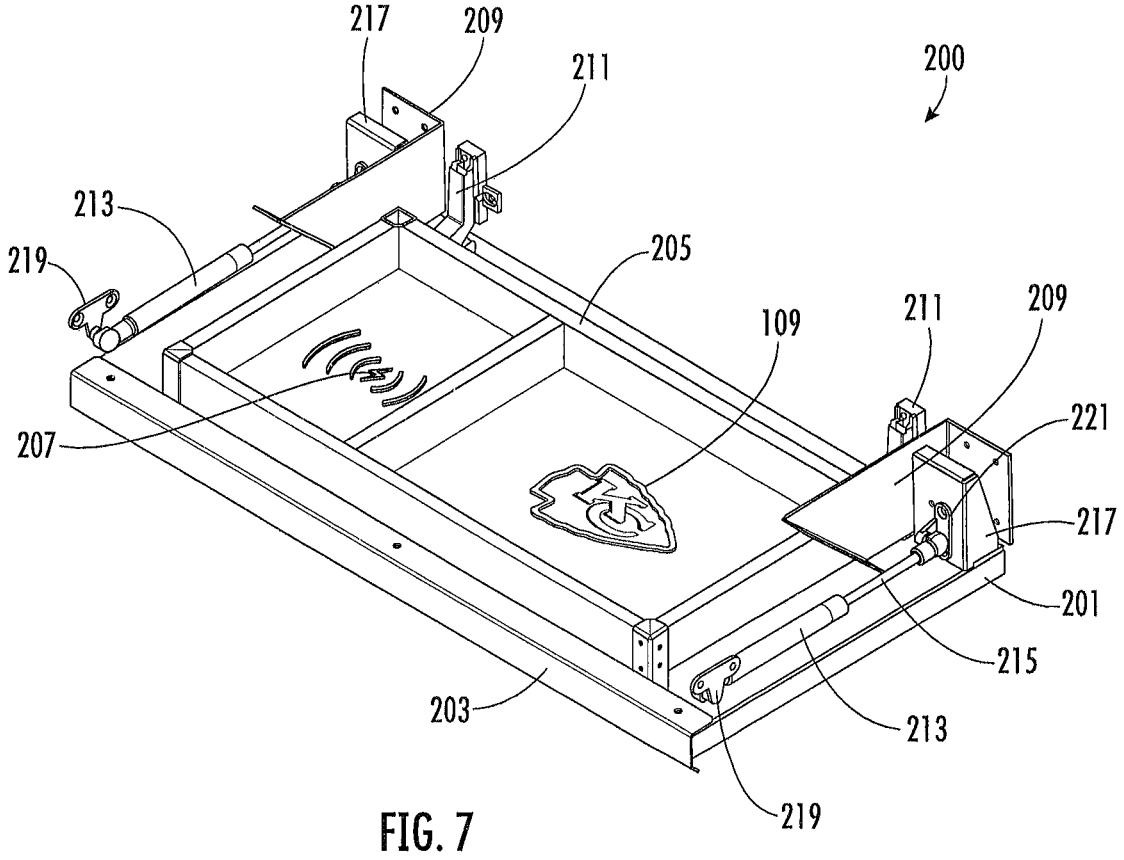
FIG. 7 is a perspective view of the jewelry tray from FIG. 1 when not attached to the locker.
Figure 8:
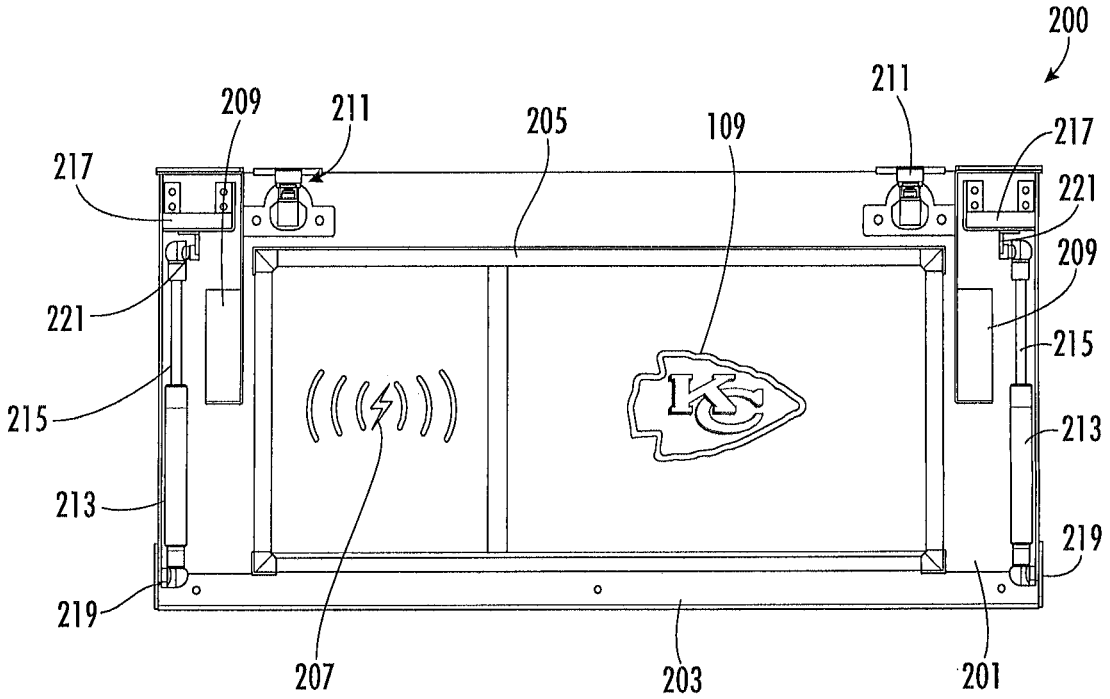
FIG. 8 is a top view of the jewelry tray from FIG. 5 when not attached to the locker.

Referring now also to FIGS. 7 and 8 in the drawings, a close-up view of jewelry tray 200 from locker 100 is depicted. FIGS. 7 and 8 show that jewelry tray 200 is comprised of a logo 109, jewelry tray base 201, metal pull handle 203, jewelry tray walls 205, wireless charger 207, jewelry tray metal stop 209, hinges 211, lift arms 213, lift arm extension 215, lift arms base 217, locker fastener 219, and rotating base fastener 221. Jewelry tray base 201 may be made out of the same material that locker 100 is made out of or, if locker 100 is made of polymer or other easier to clean material, jewelry tray base 201 may instead be made out of other materials such as laminate or wood.

Located at the front of jewelry tray is metal pull handle 203. Metal pull handle 203 is a c-shaped channel which attaches to the front of jewelry tray base 201. Pull handle 203 works as a ledge for an individual to grip when the individual decides to pull down jewelry tray base 201. Attached to the surface of jewelry tray base 201 are jewelry tray walls 205 which protrude up from the surface of base 201. Tray walls 205 are made of the same material as jewelry tray 200 and create two separate storage spaces on top of base 201 where an individual can place personal belongings. Tray walls 205 protrude far enough away from base 201 to create a lip where stored items will not fall out of jewelry tray 200 when in the folded-down position.

As shown in the figures, the storage spaces formed by jewelry tray walls 205 are different sizes and each serves a separate function. The smaller storage space on the left of jewelry tray 200 in FIGS. 7 and 8 further has wireless charger 207 imbedded below the surface of jewelry tray base 201. Wireless charger 207 is an inductive charger so that an individual can place an electronic device on the surface of tray base 201 where charger 207 is located and the electronic device will begin to charge even if the device is not in direct contact with charger 207. The other larger storage space is used to store other personal items and also has logo 109 in the center which may be the logo of the team that owns locker 100 or may be a personal logo chosen by the individual. It is appreciated that an alternative embodiment may exist where the storage space for charging electronic devices may be the same size or larger than the other storage space. An alternative embodiment may also exist where there is more than one wireless charger 207 imbedded below the surface of tray base 201 such that most of or all of the space underneath the surface of tray base 201 has a wireless charger 207.

On each side of jewelry tray 200 are lift arms 213 which use lift arm extensions 215 to facilitate movement of tray 200 between the folded-up position and the folded-down position. Lift arms 213 and lift arm extensions 215 are both cylindrical in shape but extensions 215 are smaller in diameter than lift arms 213 such that extensions 215 are stored within lift arms 213 when not in use. Lift arms 213 are connected to side walls 101 of locker 100 using locker fasteners 217 which provide extra support and stability for jewelry tray 200 while in motion. Lift arm extensions 215 are then connected to jewelry tray using lift arms bases 217 and rotating base fasteners 221. Lift arm base 217 is a protruding section of the same material which jewelry tray 200 is constructed out of. Lift arm extension 215 attaches to base 217 using rotating base fasteners 221 which causes base 217 to act as an anchor securing lifting arms 213 and arm extensions 215 to jewelry tray 200. Rotating base fasteners 221 also help facilitate movement of jewelry tray 200 between the folded-up and folded-down positions as fasteners 221 will rotate as tray 200 is pulled down so that lift arms 213 and extensions 215 will rotate up as tray 200 is moved down.

When an individual pulls on metal pull handle 203, hinges 211, lift arms 213, and lift arm extensions 215 will facilitate movement of jewelry tray. There are two hinges 211 located at the back of jewelry tray 200 near metal stop 209 which are connected to back wall 103 in locker 100. While there are two hinges 211 in the preferred embodiment, it is appreciated that an alternative embodiment may exist where there may be more than two hinges 211 connecting jewelry tray 200 to locker 100 or an embodiment where there is only one hinge 211. Hinges 211 connect the back of jewelry tray 200 to back wall 103 and create a range of motion on which jewelry tray 200 can move relative to back wall 103. When an individual pulls on jewelry tray 200, hinges 211 will tilt to facilitate movement and extensions 215 will be pulled out of lift arms 213 as jewelry tray 200 is moved to the folded down-position. However, jewelry tray 200 cannot travel the full range of motion provided by hinge 211 as metal stop 209 restricts the range of motion available. Metal stop 209 is connected to back wall 103 on one end and on the other end has a slanted edge positioned over lift arms 213 and arm extensions 215 preventing lift arms 213 and extensions 215 from tilting beyond that point and limiting the movement of jewelry tray 200. When an individual lets go of metal pull handle 203, the hydraulic force within lift arms 213 will pull arm extensions 215 back into lift arms 213 which will cause jewelry tray 200 to lift back into the folded-up position.

It is apparent that a system with significant advantages has been described and illustrated. The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered, modified and/or combined, and all such variations are considered within the scope and spirit of the application. Accordingly, the protection sought herein is as set forth in the description and claims. Although the present embodiments are shown above, they are not limited to just these embodiments, but are amenable to various changes and modifications without departing from the spirit thereof.

I claim:

1. A locker, comprising:

a main storage area defined by a pair of side walls, a back wall, and a top wall;

at least one compartment defined between the pair of side walls;

a seat assembly positioned between the pair of side walls;

a fold-down jewelry tray positioned between the side walls, the fold-down jewelry tray comprising:

a jewelry tray base; and at least one hinge disposed on a back surface of the jewelry tray base, the at least one hinge being configured to connect to the back wall of the locker;

at least one lift arm extending outwardly from an interior surface of the pair of side walls;

at least one lift arm extension at least partially disposed within the at least one lift arm, the at least one lift arm extension being configured to extend outwardly to connect to the jewelry tray base;

at least one metal stop connected to the back wall, the at least one metal stop being configured to limit movement of the at least one lift arm when the fold-down jewelry tray is pulled down; and at least one illumination panel connected to the top wall;

wherein the at least one lift arm extension extends out of the at least one lift arm when the fold-down jewelry tray is pulled down.

2. The locker of claim 1, wherein the fold-down jewelry tray further comprises:

at least one wall extending outwardly from the jewelry tray base to form at least one storage compartment.

3. The locker of claim 1, wherein the fold-down jewelry tray is made of the same material as the rest of the locker.

4. The locker of claim 1, wherein the fold-down jewelry tray is made of a different material than the locker.

5. The locker of claim 1, wherein the fold-down jewelry tray further comprises:

at least one inductive charger disposed within the jewelry tray base.

6. The locker of claim 1, wherein the fold-down jewelry tray further comprises:

a metal pull handle disposed along a front surface of the jewelry tray base.

7. The locker of claim 1, wherein the illumination panel comprises:

a back support bar.

8. The locker of claim 1, wherein the illumination panel is detachable from the locker.

9. The locker of claim 1, wherein the illumination panel is slotted so that material may be inserted into the illumination panel.

10. The locker of claim 1, wherein the illumination panel is a digital display screen.

11. The locker of claim 1, wherein the illumination panel can be remotely activated.

12. The locker of claim 1, wherein the illumination panel activates when the locker is approached.

* * * * *